US006776357B1

(12) United States Patent
Naito

(10) Patent No.: US 6,776,357 B1
(45) Date of Patent: Aug. 17, 2004

(54) SHOWERHEAD

(76) Inventor: Yosuke Naito, 654-235, Kamiya-cho, Kasugai-shi, Aichi 486-0817 (JP)

( * ) Notice: Subject to any disclaimer, the term of this patent is extended or adjusted under 35 U.S.C. 154(b) by 0 days.

(21) Appl. No.: 09/807,919

(22) PCT Filed: Oct. 8, 1999

(86) PCT No.: PCT/JP99/05613

§ 371 (c)(1),
(2), (4) Date: Apr. 19, 2001

(87) PCT Pub. No.: WO00/22972

PCT Pub. Date: Apr. 27, 2000

(30) Foreign Application Priority Data

Oct. 22, 1998 (JP) ..... 10-301425

(51) Int. Cl.[7] ..... B05B 1/30

(52) U.S. Cl. ..... 239/533.14; 239/107; 239/315; 239/552; 239/553; 239/602; 239/DIG. 12

(58) Field of Search ..... 239/106, 107, 239/315, 317, 533.13, 533.14, 552, 558, 559, 562, 567, 553, 553.3, 548, 602, DIG. 12, 546

(56) References Cited

U.S. PATENT DOCUMENTS

| | | | | | |
|---|---|---|---|---|---|
| 1,422,291 | A | * | 7/1922 | Mulherin | 239/602 |
| 2,402,741 | A | * | 6/1946 | Draviner | 239/533.14 |
| 2,690,930 | A | * | 10/1954 | Corson | 239/315 |
| 2,975,980 | A | * | 3/1961 | Siebert et al. | 239/315 |
| 3,008,650 | A | * | 11/1961 | Prokop, Sr. | 239/567 |
| 3,402,893 | A | * | 9/1968 | Hindman | 239/533.14 |
| 5,405,089 | A | | 4/1995 | Heimann et al. | |
| 5,730,361 | A | * | 3/1998 | Thonnes | 239/106 |
| 5,730,362 | A | * | 3/1998 | Cordes | 239/602 |
| 5,957,387 | A | * | 9/1999 | Porta et al. | 239/315 |

FOREIGN PATENT DOCUMENTS

| | | |
|---|---|---|
| EP | 0597344 A1 | 5/1994 |
| JP | 49-45625 | 12/1974 |
| JP | 61-147176 | 9/1985 |
| JP | 2-142638 | 12/1990 |
| JP | 5-22048 | 3/1993 |
| JP | 7-13454 | 3/1995 |
| JP | 8-266940 | 10/1996 |
| JP | 9-192043 | 7/1997 |
| JP | 9-252987 | 9/1997 |

* cited by examiner

*Primary Examiner*—Steven J. Ganey
(74) *Attorney, Agent, or Firm*—Muramatsu & Associates

(57) ABSTRACT

A showerhead which automatically adjusts the outlet pressure of the water in accordance with changes in water pressure, and eliminates the operation of a faucet, thus enabling showers to be taken comfortably. The showerhead (1) spurts the water, which is flowing from a water source to the specified pipes, through the outlet holes (H) of the shower nozzle (5). The shower nozzle (5) comprises waterproof elastic materials such as silicon rubber or the like. The elastic surface of the shower nozzle (5) incorporates outlet holes (H) which can be enlarged and reduced in accordance with changes in water pressure inside the showerhead (1).

12 Claims, 11 Drawing Sheets

(A)

(B)

Typical Existing Showerhead

Water Pressure Inside Showerhead

Proposed Showerhead

Water Pressure Inside Showerhead.

SHOWERHEAD

FIELD OF THE INVENTION

This invention relates a showerhead which is used for shower equipment in houses, hotels or the like. Also, the showerhead of this invention may be used for sprinklers in agriculture or washing equipment for automobiles, machines or the like.

BACKGROUND OF THE INVENTION

In general, shower equipment incorporates a showerhead with a hose connected with a water faucet. A showerhead incorporates a grip ring placed on the end of a hose, and a disk face plate as a shower nozzle is installed on the edge of the grip ring. Multiple outlet holes are drilled at regular intervals on the surface of the shower nozzle.

In general, hard plastic is used as a structural material for shower nozzles. Stainless or such metals are also known as materials for shower nozzles. Normally the diameter of each outlet hole is approximately 1 to 1.5 millimeters.

When the faucet is open, cold water or hot water comes out from the outlet holes of the shower nozzle through the hose and the grip ring.

In the use of such an existing showerhead, when the water pressure is high enough, water comes out strongly enough from the holes of the shower nozzle. However, once the water pressure inside the shower nozzle goes down, the water pressure from the nozzle also goes down, then water drops without force from the surface of the shower nozzle. For example, when a shower is in use in a bathroom and then another water source is used for washing, cooking or the like, the water pressure in the bathroom becomes insufficient for use.

Also, in the use of existing showerheads, it is difficult to adjust the opening and closing of the faucet when the water pressure in the showerhead in use is too high. For example, if many people taking shower in a public bathhouse or the like stop using water and only one person continues to take shower, the pressure of water used by this one person becomes too high and he may need to adjust the faucet to lower the water pressure.

This invention was developed in light of the above inconveniences, and the purpose of this invention is to automatically adjust the outlet water pressure of a showerhead according to changes in water pressure, and to omit troublesome adjustments of the faucet, thus enabling us to shower comfortably.

SUMMARY OF THE INVENTION

The inventor here proposes a showerhead to sprinkle water flowing through a pipe from a water source, of a shower nozzle, whose flexible surface comprises elastic and waterproof materials, and incorporates outlet holes which can be enlarged and reduced in accordance with changes in water pressure in the showerhead.

In the showerhead in this invention, in the event of water pressure inside the showerhead being low, the shower nozzle will expand slightly and thus keep the diameter of the outlet holes small. Thus, outlet pressure of water at the shower nozzle increases and the water comes out forcefully.

On the other hand, in the event of water pressure inside the showerhead being high, the shower nozzle will expand and thus increase the diameter of the outlet holes. Thus, the volume of water coming out from the nozzle increases and outlet pressure is controlled, so that the force of the water can be appropriately maintained.

In other words, the outlet pressure of the shower nozzle is automatically adjusted by the diameter of the outlet holes which are enlarged or reduced in accordance with changes in water pressure.

A ring stopper is preferably mounted around the outer circle of the nozzle of the showerhead.

The diameter (D) of the aforementioned outlet hole should preferably be set between 0.1 mm and 0.9 mm under conditions where the aforementioned elastic surface has no load.

The showerhead should preferably be formed like a bag, and a tightening structure to prevent water leakage should preferably be mounted on the opening side of this bag-shaped showerhead.

A protection plate should preferably be placed in the showerhead to support the elastic surface from inside.

Also, water quality enhancer should preferably be provided in the showerhead. Convex and concave surfaces should preferably be provided on the aforementioned elastic face and the aforementioned outlet holes could be provided optionally ether on the convex or the concave side.

The diameter of the aforementioned outlet holes should preferably be progressively smaller from inside to outside of the head.

The aforementioned shower nozzle should be held between the plates incorporating a hole, and the aforementioned outlet holes should be provided on the aforementioned plates incorporating a hole.

The edges of the outlet hole entrance should be tapered.

DETAILED DESCRIPTION OF THE PREFERRED EMBODIMENTS

The following is an explanation based on drawings of the embodiments of this invention.

Figure 1:
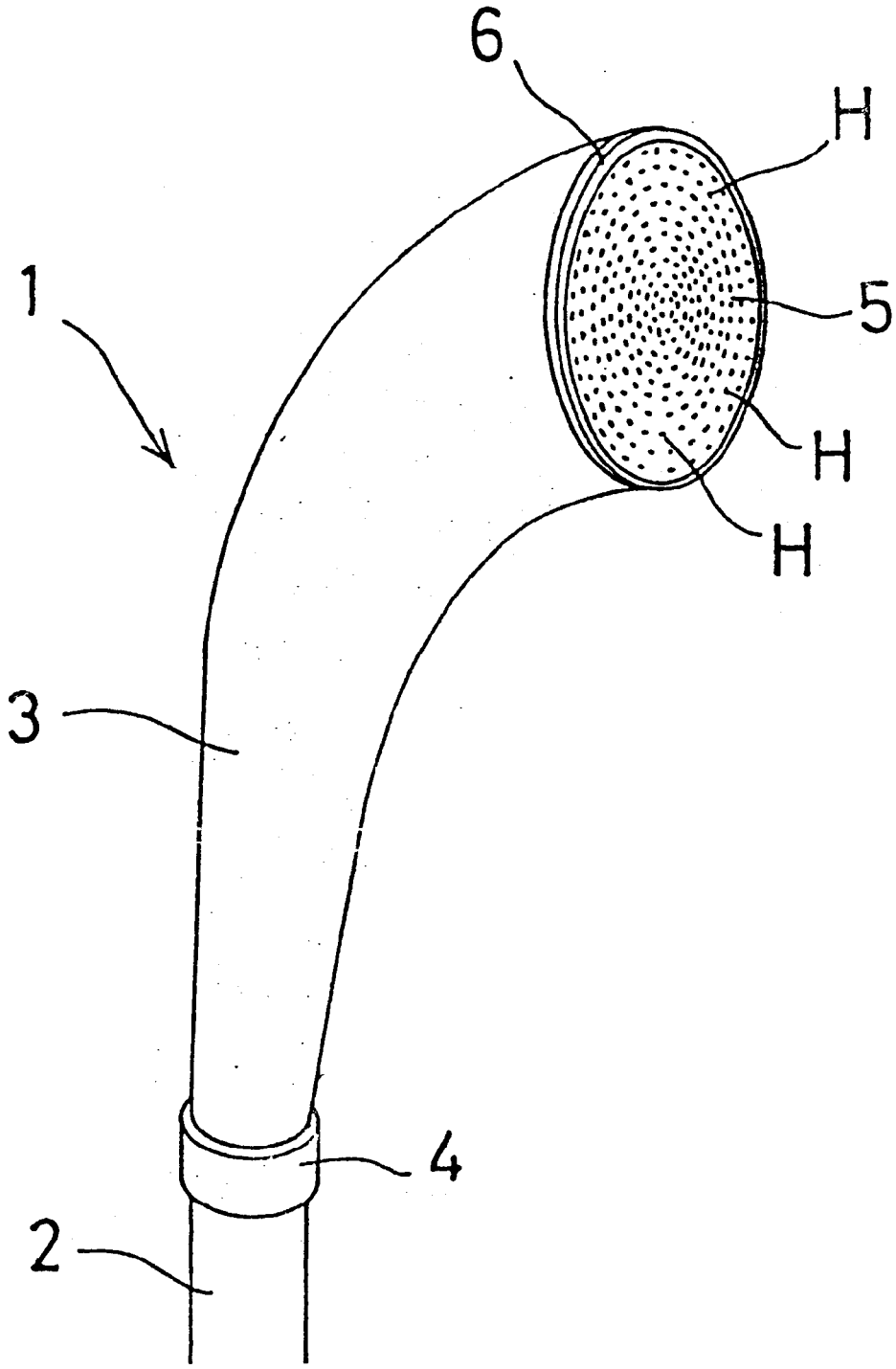
FIG. 1 is a perspective view of a showerhead as the first embodiment of this invention.
Figure 2:
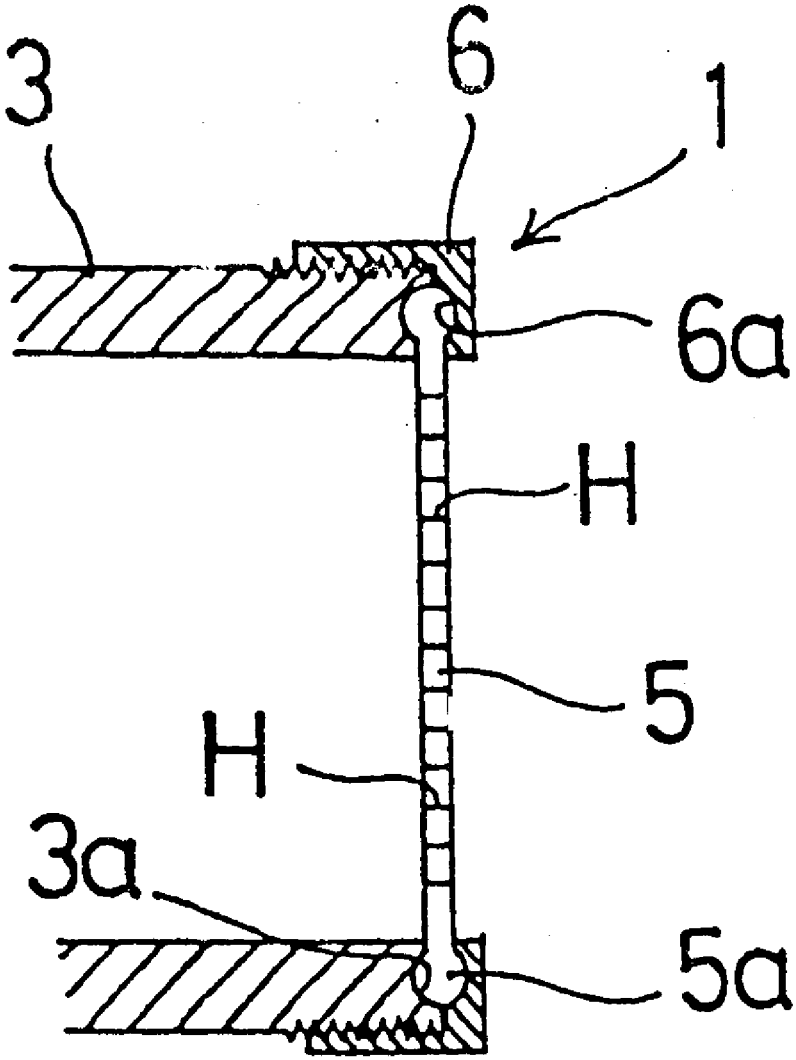
FIG. 2 shows a sectional view of a showerhead as the first embodiment of this invention.
Figure 3:
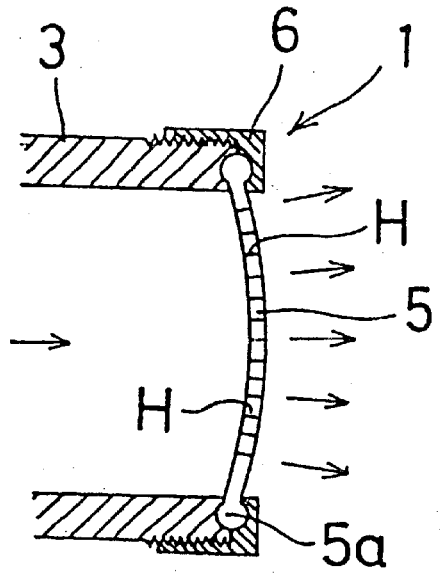
FIG. 3 shows a showerhead as the first embodiment of this invention. FIG. (A) is a sectional view of the showerhead in use when little water is flowing and FIG. (B) is a sectional view of the showerhead in use when more water is flowing.
Figure 3:
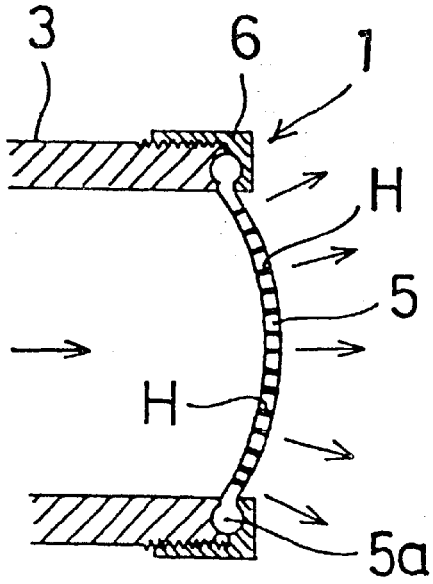

A showerhead as the first embodiment of this invention is shown in FIGS. 1 to 3.

Showerhead 1 as proposed in this invention is to apply to the shower equipment in the bathroom.

Water flows, through the pipe, from the water source to the shower equipment under an almost even pressure. Once the faucet in the bathroom is open, cold water or hot water comes out of the showerhead 1. The pipe from the water source is connected with other faucets as well as the faucet of the shower equipment, and opening and closing the other faucets makes the water pressure in showerhead 1 change.

A showerhead (1) as shown in FIGS. 1 and 2, is connected with a hose 2. A grip (3) is firmly fixed on one end of the hose (2) with a snap ring. A round shower nozzle (5) is fixed on the head of the grip (3) with a round stopper (6). When the shower nozzle (5) is damaged or choked with dirt or the like, the round stopper (6) is removed so that the shower nozzle (5) can be easily replaced.

The shower nozzle is made of waterproof elastic materials such as rubber or resin (vinyl, nylon, polyethylene, plastic, elastomer, or the like). The multiple outlet holes (H) are concentrically drilled on the surface of the shower nozzle (5).

In order to manufacture the shower nozzle (5), plate material made of the specified elastic materials should be processed to fit the size of the head of the grip (3), and the outlet holes (H) should be drilled on the surface of the nozzle by a press or the like, or the whole nozzle incorporating the outlet holes (H) can be produced by a molding machine.

In particular, the material for the shower nozzle (5) would favorably be a silicon rubber. Silicon rubber has an appropriate waterproofness and elasticity as well as resistance to heat, rust and corrosion.

Also, silicon rubber is a material whose elasticity does not readily change with temperature nor with water temperature changes. Therefore, a shower nozzle made of silicon rubber is very practical since the difference in the diameter of the outlet holes is still small even if the nozzle is used at a comparatively wide rage of water temperatures.

The diameter of the outlet holes (11) should be set after estimating the expansion rate of the elastic materials against the water pressure. For example, when the shower nozzle is without load, the diameter of the outlet holes should be set between 0.1 and 0.9 mm or more preferably between 0.1 and 0.5 mm. According to experiments by the inventor, if the diameter of the outlet holes is set at the above-identified values, it is not necessary to adjust the faucet in accordance with the water pressure in daily life, and possible to enjoy taking a shower with an effective and appropriate quantity of water.

Furthermore, if the diameter of the outlet holes is set between 0.1 and 1.5 mm under a water pressure of 0 to 0.5 $kgf/cm^2$ against the elastic surface of the shower nozzle, or between 1 and 3.0 mm under a water pressure of 1 to 3 $kgf/cm^2$, it is possible to take a shower comfortably without changes in water pressure.

The outlet holes (H) should be evenly located on the entire surface of the shower nozzle (5), or can be located intensively in the center area of the nozzle. If the outlet holes are provided only in the center area of the nozzle, the elastic material expands, thus the spreading range of shower water becomes narrow enough to apply water to the desired area. Although, in the aforementioned first embodiment, the outlet holes (H) are concentrically provided on the surface of the shower nozzle, other patterns such as lattice, random, or the like may also be provided.

The intervals of each outlet hole (H) can be set by considering the thickness of the shower nozzle (5), diameter of the outlet holes, or the like. For example, the intervals of outlet holes of a showerhead for family use should preferably be set for 1 to 5 mm. When elastic material is used for the shower nozzle (5), and the nozzle is made as a flat plate of even thickness, the shower nozzle will easily come off the grip (3) if the nozzle expands and contracts. Then, as shown in FIG. 2 of this embodiment, the shower nozzle (5) incorporates a round hooking projection (5*a*) which forms all along the outer circle of the nozzle. The thickness of the round hooking projection (5*a*) is much thicker than that of the elastic area of the shower nozzle (5). A ring portion of the round hooking projection (5*a*) is molded together with shower nozzle (5).

As shown in FIG. 2, channels (3*a*) and (6*a*) are provided in the head of the grip (3) and a ring stopper (6) such that the round hooking projection (5*a*) can be inserted. When the round hooking projection (5*a*) is set in channels (3*a*) and (6*a*) and the ring stopper (6) is fixed to the grip (3) with screws, the round hooking projection is compressed in channels (3*a*) and (6*a*), and eventually prevents the shower nozzle (5) from coming off when expanding and contracting. Also, the round hooking projection (5*a*) functions as an O-ring to prevent water from leaking.

When the water enters the grip (3) while the showerhead is in use, air in the grip (3) comes out of the outlet holes (H). At this time, the diameter of the outlet holes is kept small so that water will be kept inside the grip (3) without flowing out of the outlet holes (H).

When the grip (3) is filled with water and the pressure becomes high, the shower nozzle (5), as shown in FIG. 3 (A), expands outwardly by water pressure inside the grip (3), then the outlet holes (H) will be slightly enlarged. Thus, water inside the showerhead (1) will come out from the outlet holes (H) at the appropriate pressure.

Also, as shown in FIG. 3 (B), as the water pressure becomes higher, the shower nozzle (5) expands and the outlet holes (H) expand more. The water pressure inside the showerhead (1) is controlled by the outlet holes (H) so that the pressure of the shower water cannot be too strong. At the same time, the shower nozzle (5) greatly expands and the shower water spreads widely, then the person taking a shower can enjoy sufficient water.

When the water pressure drops as other faucets open, the shower nozzle (5) immediately contracts. At this time, the outlet holes (H) contract as shown in FIG. 3 (A) from the condition of the outlet holes (H) expanded as shown in FIG. 3 (B), so that an appropriate pressure of shower water can be obtained.

Figure 4:
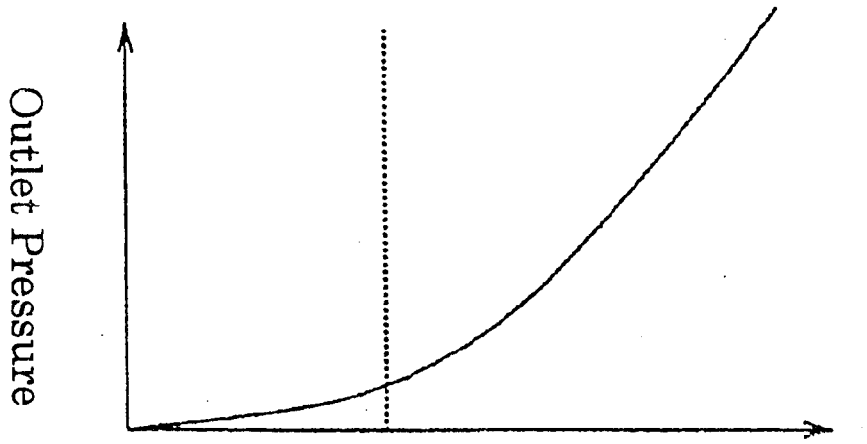
FIG. 4 is a graph showing the relationship between water pressure and outlet pressure in a typical existing showerhead.
Figure 5:
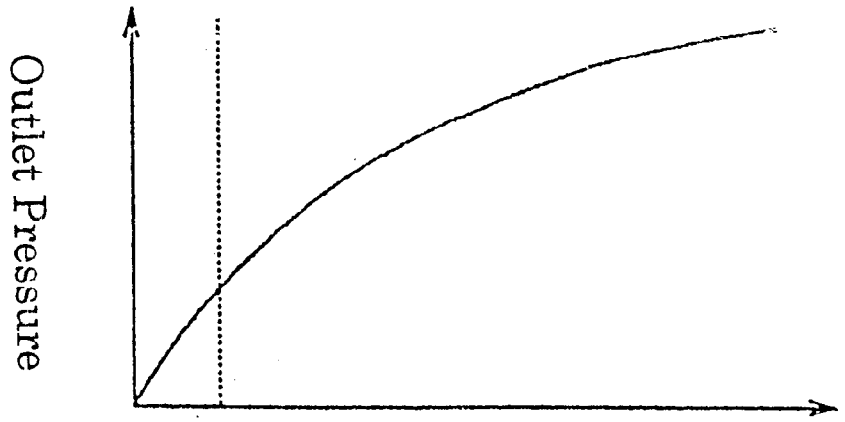
FIG. 5 is a graph showing the relationship between water pressure and outlet pressure in the proposed showerhead.

FIGS. 4 and 5 describe the relation between water pressure and outlet pressure.

When existing hard plastic or metal shower nozzles are used, even if water pressure inside the showerhead increases gradually from zero pressure, the shower water will not come out below a certain pressure (see the broken line in FIG. 5) since sufficient outlet pressure cannot be added to the shower nozzle. In other words, water coming out of the outlet holes only runs to the shower nozzle and emerges in drips. On the other hand, when water pressure inside the showerhead increases to a certain point, shower water will suddenly spurt from the outlet holes. If the water pressure inside the showerhead becomes much higher, the outlet pressure of shower water will become excessively high.

However, in the showerhead (1) of this invention, as shown in FIG. 5, appropriate outlet pressure is created in the outlet holes above a certain minimum water pressure (see the broken line of FIG. 5) even if the quantity of water is small and the pressure is low, since the diameter of the outlet holes (11) is small enough to provide less water with appropriate pressure.

On the other hand, even if the water pressure inside the showerhead increases, outlet pressure will increase only gently since expansion of the shower nozzle (5) gradually enlarges the diameter of the outlet holes (H), thus the strength of the shower water can be properly controlled.

Therefore, the showerhead (1) can provide appropriate water in a wide area under sufficient pressure, expanding and contracting the diameter of the outlet holes (H) in accordance with the changes in water pressure. For example, even if water pressure drastically changes according to the number of people using the shower equipment in the bathroom or the like, each person will not need to readjust the opening and closing of the faucet. Also, even if the quantity of the water is small and under low pressure, sufficient shower water can be maintained, and this will also help in saving water. According to experiment by the inventor, approximately 20 liters of water is used in taking a shower using existing shower equipment, however, if the equipment newly proposed in this embodiment is used, the quantity of water required may be reduced by about half.

Also, the inner space of the showerhead (1) has a function like a chamber such that the shower water can spurt evenly from the shower nozzle. For example, once cold water and hot water are sent into the showerhead (1), those two different temperatures water are well mixed in the showerhead before spurting from the shower nozzle, and this keeps the water temperature even. Also, if a water quality enhancer such as an active carbon, or other chemical substance or the like is provided in the showerhead (1), the quality of the shower water will become better and stable.

Figure 6:
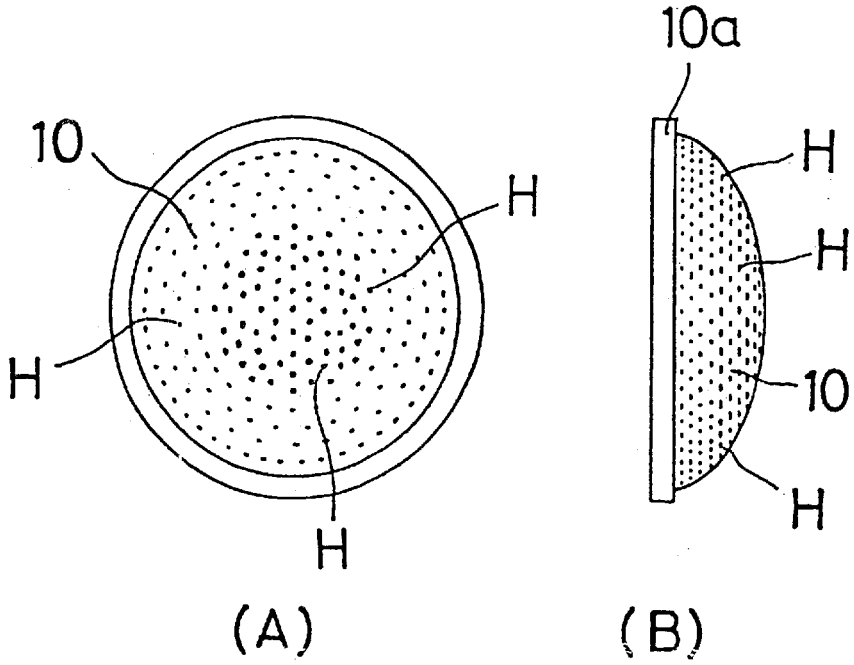
FIG. 6 shows a shower nozzle of a showerhead as the second embodiment of this invention. FIG. (A) is a top view of the shower nozzle and FIG. (B) is a side view of the showerhead.
Figure 7:
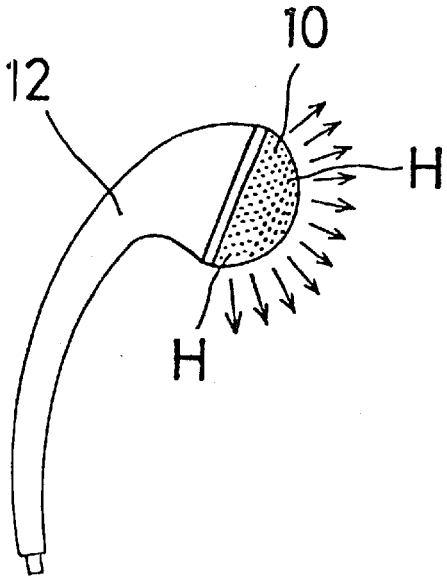
FIG. 7 is a side view of a showerhead as the second embodiment of this invention.

FIGS. 6 and 7 show the second embodiment of this invention.

The second embodiment incorporates a dorm-shaped shower nozzle (10). On the surface of the shower nozzle (10), the outlet holes (H) are concentrically located in even intervals. A ring stopper (10*a*) to be connected with the edge of the grip (12) is provided around the outer circle of the shower nozzle (10). Waterproof elastic materials are used for the structural elements of the shower nozzle (10). The diameter of the outlet holes (H) located in the central area of the shower nozzle is larger than that of outlet holes (H) located on the outer part of the shower nozzle, such that the quantity of water spurting from the center of shower nozzle (10) is larger than that of the water spouted from the outer part of shower nozzle (10).

In the second embodiment, as the water pressure inside the showerhead gradually increases, shower water will spurt from the center of the shower nozzle, then the water will spurt from the center and outer area of the shower nozzle simultaneously. In other words, the diameter of the outlet holes (11) expands and contracts according to changes in water pressure in order to provide a proper shower effect.

Also, the second embodiment can provide water over a wide area even if water pressure is low, since the shower nozzle (10) is dorm-shaped.

Figure 8:
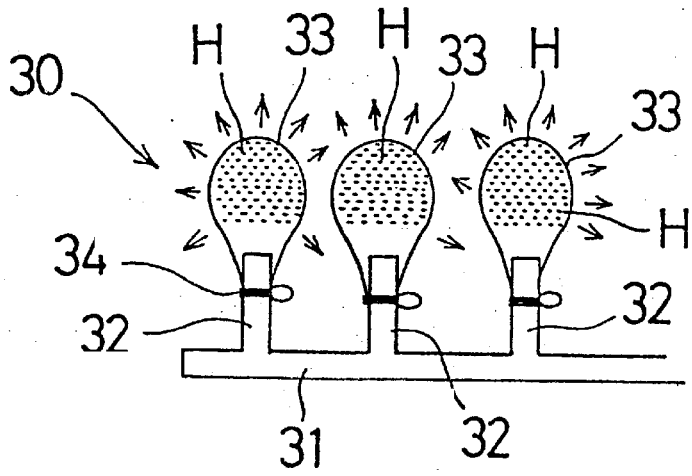
FIG. 8 is a side view of a showerhead as the third embodiment of this invention.

FIG. 8 is the third embodiment of this invention.

The third embodiment is an example in which the invention is applied to a sprinkler system for gardening or agriculture.

In order to install the sprinkler system (30), a water pipe (31) should be placed along the edge of flower gardens, green houses or the like. Branched pipes (32) for sprinklers are located in the specific areas of the water pipe. Sprinklerheads (33) in the shape of small bags are fixed on the edge of the branched pipes (32) tightened with bands (34).

The sprinklerhead (33) comprises waterproof elastic materials such as silicon rubber or the like, and the shower nozzle should be molded together with the sprinklerhead. The outlet holes (H) for water are provided evenly at regular intervals over the entire area of the sprinkerhead (33).

When the sprinkler is in operation, the water stays in the sprinklerhead (33) to be expanded, the outlet holes (H) are enlarged, and then an appropriate quantity of water is sprinkled over the area. When water pressure inside the sprinklerhead is low, the outlet holes (H) are kept small and the outlet pressure is controlled so as to be high enough to obtain sufficient water. On the other hand, when water pressure is high, the outlet holes (H) are enlarged and the outlet pressure is controlled so that the shower water will not spurt strongly.

By using the sprinkler system (30) as shown in the third embodiment, the water can efficiently be sprinkled over a certain area from a certain distance where the shower nozzles (33) are located, even if the water pressure inside the water pipe (31) changes. Also, the sprinkler system (30) can provide the water gently at one spot so that soil will not be displaced.

Furthermore, the water can be moisturized by reducing the diameter of the outlet holes (H) so that the water can efficiently and evenly be provided for the products or the surface of the soil.

The sprinkler system (3) of the third embodiment can also provide the excellent feature of supplying water for lawns on golf courses, sports stadiums or the like as well as in garden or agricultural land.

Figure 9:
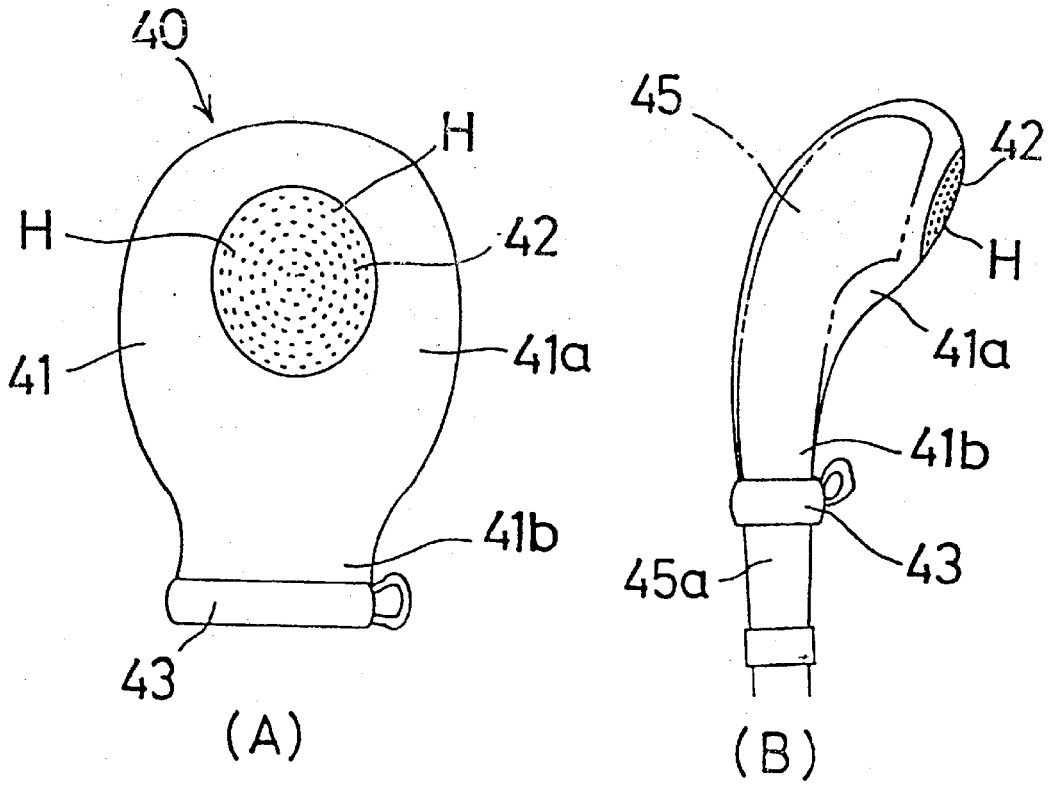
FIG. 9 shows a showerhead as the fourth embodiment of this invention: FIG. (A) is a front view of the showerhead and FIG. (B) is a side view of the showerhead.
Figure 10:
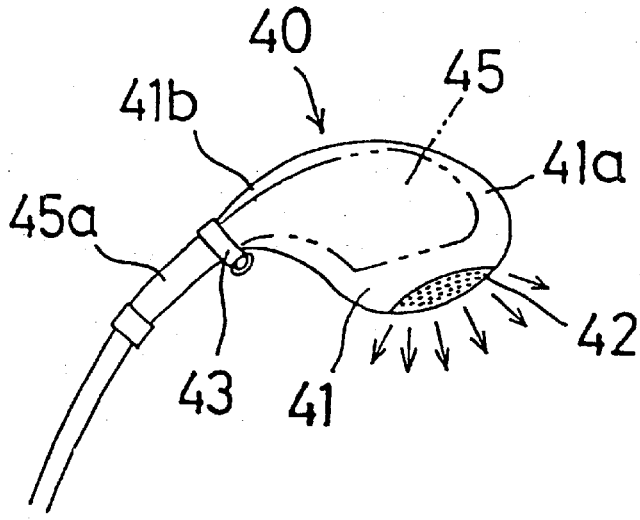
FIG. 10 is a side view of the showerhead as the fourth embodiment of this invention when in use.

FIGS. 9 and 10 show the fourth embodiment of this invention.

The fourth embodiment shows an existing showerhead whose top is covered with a removable showerhead (40).

The showerhead (40) incorporates a showerhead bag (41), a nozzle mat (42) and a tightening band (43). The showerhead bag (41), nozzle mat (42) and tightening band (43) comprise waterproof elastic materials such as silicon rubber.

The showerhead bag (41) incorporates a head area (41*a*) and a neck area (41*b*) along the outer shape of the original showerhead (45) which is a normal and traditional showerhead. A round hole is provided in the center of the head area (41*a*), and a round nozzle mat (42) is attached covering this round hole. The outlet holes (H) are provided on the surface of the nozzle mat (42).

The nozzle mat (42) should preferably be more elastic than the showerhead bag (41) such that the nozzle mat (42)

can expand and contract first, then the outlet holes (H) will be enlarged or reduced in accordance with the volume of water in the showerhead bag (41). For example, the elasticity of the nozzle mat (42) can be improved by applying more elastic material to the nozzle mat (42) than the material of the showerhead bag (41), or by providing less thickness in the nozzle mat (42) than that in the showerhead bag (41).

A band (43) is placed around the outer circle of the neck area (41*b*). The band (43) can be tightened with the grip (45*a*) of the showerhead (45).

When the shower nozzle (40) of the fourth embodiment is used, the showerhead (45) should be covered with the showerhead bag (41), then the grip (45*a*) should be tightened with the band (43) so that the water will not leak from the showerhead bag (41).

When the water spurts from the showerhead (45) under the aforementioned condition, the showerhead bag (41), as shown in FIG. 10, will expand with the water kept inside. The water pressure inside the showerhead bag (41) increases, and water will spurt from the outlet holes (H). According to changes of the water pressure inside the showerhead (41), the diameter of the outlet holes (H) will be enlarged or reduced, and shower water can be properly obtained.

For example, when the appropriate water pressure cannot be obtained from shower equipment at a hotel or the like, fitting the shower nozzle (40) can provide comfortable shower at any time.

Figure 11:
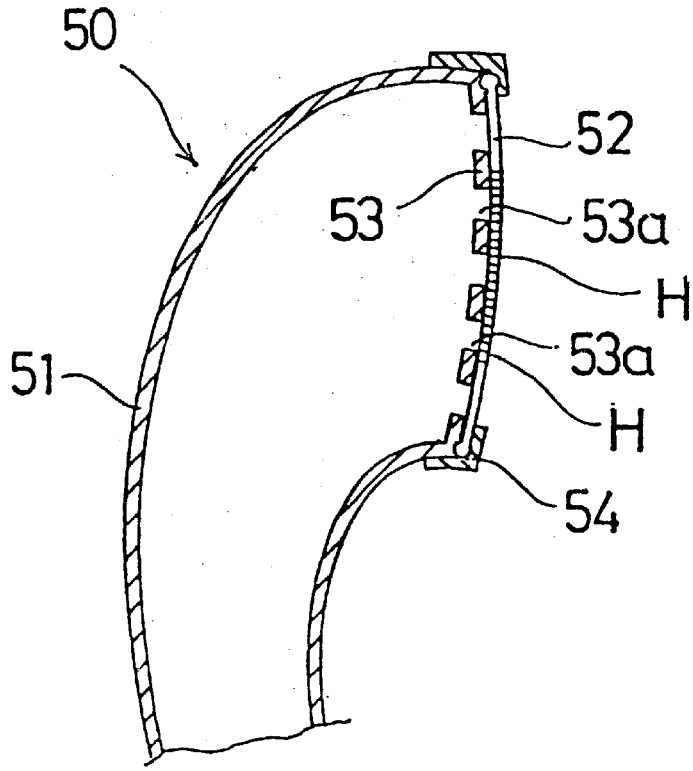
FIG. 11 is a sectional view of the showerhead as the fifth embodiment of this invention.
Figure 12:
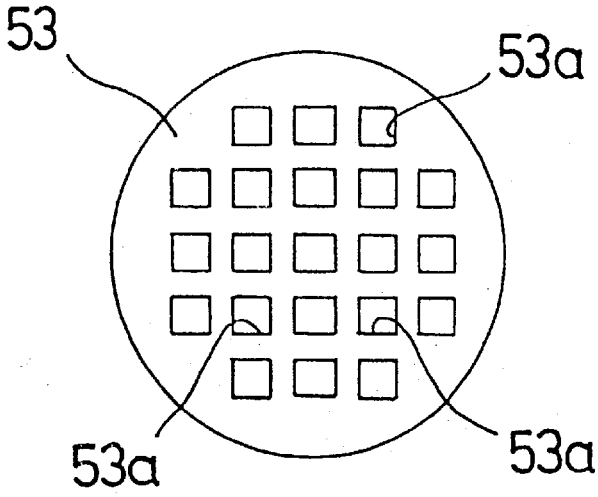
FIG. 12 is a top view of the protection plate of the showerhead as the fifth embodiment.

FIGS. 11 and 12 show the fifth embodiment of this invention.

The showerhead (50) as the fifth embodiment incorporates a protection plate (53) inside the shower nozzle (52). The protection plate (53) is mounted on the head of the grip (51). The round shower nozzle is fixed on the outer surface of the protection plate (53) with the ring stopper (54).

As shown in FIG. 12, the protection plate incorporates water outlet holes (53*a*) at regular intervals. The water inside the showerhead (50) flows to the shower nozzle (52) through the water outlet holes (53*a*). The water outlet holes are of sufficient size as to keep the water inside the grip (51) at a smooth and constant flow.

Although the protection plate (53) in FIG. 12 has the water outlet holes square, it may be possible to have them round, or the protection plate (53) can be a net type.

The fifth embodiment can provide shower water under any conditions of water pressure, and the protection plate (53) prevents the shower nozzle (52) from becoming concave inside. Even if, for example, the water in the pipe flows backward, an excessive load will not be added to the shower nozzle (52). This greatly enhances the durability of the showerhead.

Figure 13:
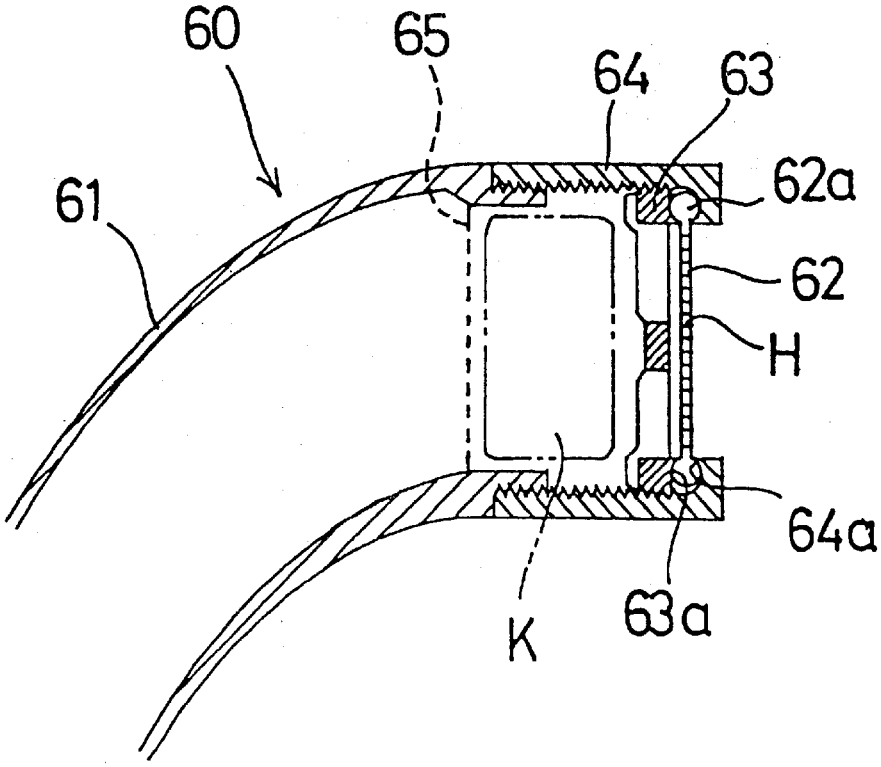
FIG. 13 is a sectional view of the showerhead as the sixth embodiment of this invention.
Figure 14:
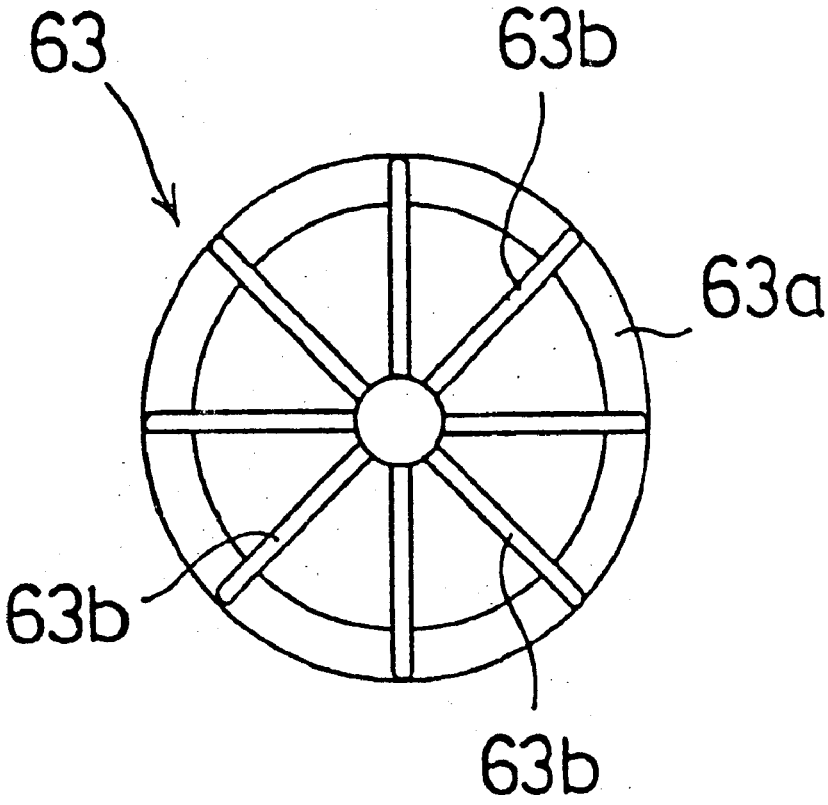
FIG. 14 is a top view of the fixer of the showerhead as the sixth embodiment of this invention.

FIGS. 13 and 14 show the sixth embodiment.

Nowadays, as a technical improvement, some showerheads incorporate active carbon, an aromatic, or the like which improves the quality of the water, in the waterway of the showerhead. The showerhead (60) as the sixth embodiment incorporates a water quality enhancer (K) in the waterway inside the showerhead.

When a water quality enhancer is placed in the waterway inside the showerhead, as shown in the aforementioned first or the fifth embodiment, the water quality enhancer (K) is normally placed inside the grip with the lid of shower nozzle, and the shower nozzle is tightened with the ring stopper from outside. However, if the shower nozzle is tightened from outside the showerhead, the shower nozzle easily comes off the ring stopper when the water quality enhancer is replaced with a new one. Thus, in the sixth embodiment, the shower nozzle (62) is mounted from inside the nozzle cap (64), making it easier to change the water quality enhancer.

As shown in FIG. 13, the nozzle cap (64) is screwed and fixed on the edge of the grip. A space for the water quality enhancer is provided in the nozzle cap (64) by a partition plate (65).

The shower nozzle (62) is fixed on the inner edge of the nozzle cap (64) with a round fixer (63). On the edges of the fixer (63) and the nozzle cap (64), channels (63*a*) and (64*a*) are provided for connecting the round hooking projection (62*a*) forming around the shower nozzle (62).

As shown in FIG. 14, the fixer (63) comprises a ring (63*a*) and ribs (63*b*). The ring (63*a*) and ribs (63*b*) should be processed together by using resin or the like. Ribs (63*b*) radiate from the center of the ring (63*a*). Each space between the ribs (63*b*) becomes a waterway. Screw channels are provided on the outer surface of the ring (63*a*) to be tightened inside the nozzle cap (64).

To replace the water quality enhancer (K), the nozzle cap (64) is removed from the grip (61) first, then the water quality enhancer (K) can be taken out. At this time, the shower nozzle (62) will not come off the nozzle cap (64) since the shower nozzle (62) is firmly fixed on the edge of the cap with the fixer (63). Thus, a new water quality enhancer (K) is placed in a specified position, and the nozzle cap (64) is tightened with the grip (61).

On the other hand, for replacing the shower nozzle (62), the nozzle cap (64) is removed from the grip (61), the fixer (63) is loosed, then the shower nozzle (62) can be removed from the nozzle, cap (64). The fixer (63) can easily be rotated by moving the rib (63*b*). After that, the shower nozzle (62) can be replaced with a new one to be set in the channels (63*a*) and (64*a*), then the new shower nozzle (62) is again tightened in the nozzle cap (64) with the fixer (63).

Thus, in the sixth embodiment, the shower nozzle can easily be replaced with a new one when desired, and the water quality enhancer (K) can easily and surely be replaced. Therefore, a showerhead with a water quality enhancer (K) becomes more practical.

The shape of the fixer (63) need not be limited only to the shape in this embodiment, but it can be any shape as long as the fixer (63) can be fitted to the inner circle of the showerhead. For example, the rib (63*b*) can be in the shape of a cross or a net, or it may be omitted entirely.

The shape of the showerhead described above is not limited to the shapes in the aforementioned first to sixth embodiments, it can also be a multilateral or oval shape. Likewise, the shape of the grip is not limited to the shapes as shown in the aforementioned first to sixth embodiments.

The shower nozzle can have even thickness throughout, and its shape can be variously changed depending on the purpose of use. For example, as shown in FIGS. 15(A) and (B), dimples can be provided on the surface of the shower nozzles (71) and (72), and the outlet holes (H) can optionally be provided either on the convex portions (71*a*) or concave portions (72*a*) Providing the outlet holes (H) on the convex portions (71*a*) thickens the area of the outlet holes (H) and enhances the durability of the shower nozzle. On the other hand, providing the outlet holes (H) on the concave portions (72*a*) makes the outlet holes (H) expand and contract more easily, and thus more sensitive to slight changes in the water pressure.

Also, as shown in FIG. 15(C), the thickness of the shower nozzle (73) can be reduced gradually toward the central area from the outer area so that the elastic surface becomes less and the area where the shower water is applied can be smaller.

Also, as shown in FIG. 16(A), concave portions (74*a*) and convex portions (74*b*) can be created by providing dimple processing on both sides of the shower nozzle (74). In this case, the thickness around the outlet holes (H) becomes thick enough to enhance the durability of the elastic surface.

Figure 16:
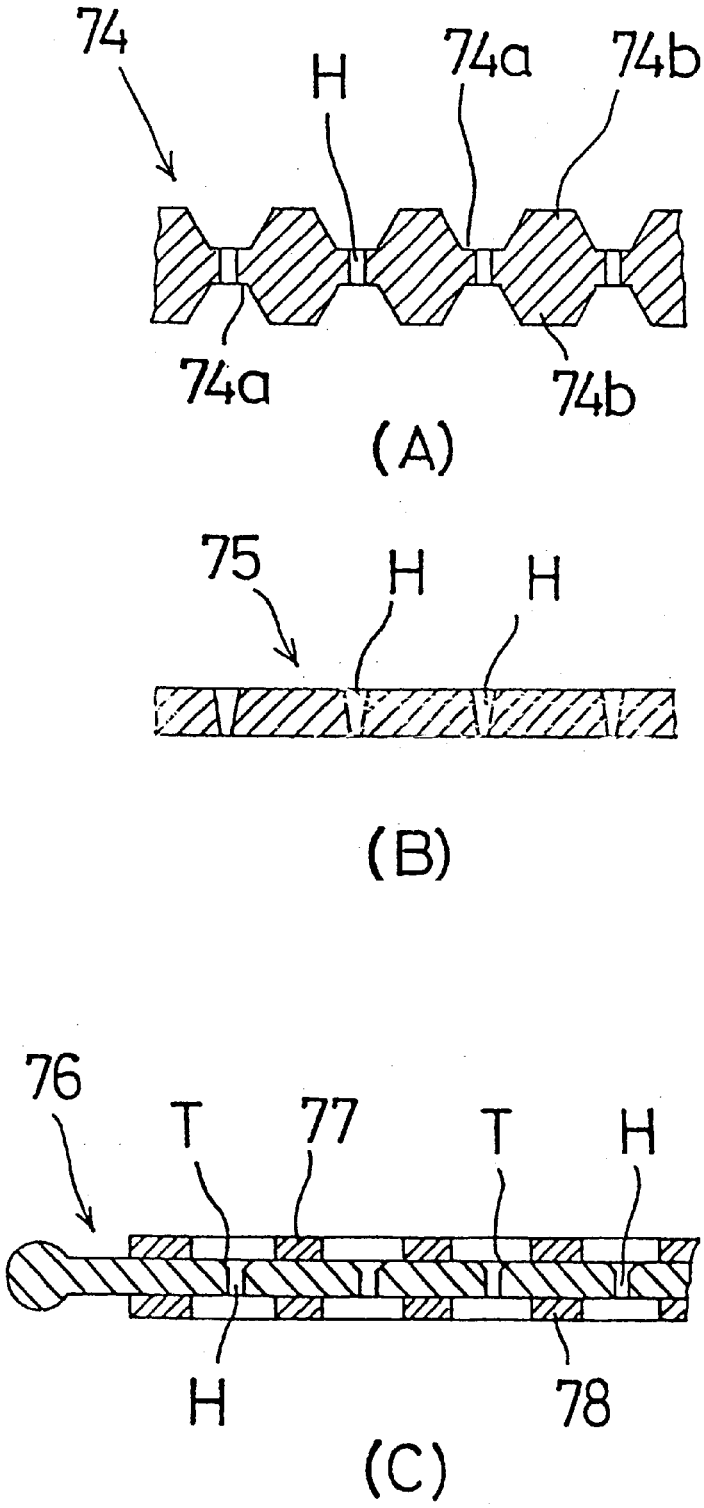
FIG. 16 shows a sectional view of different types of shower nozzles as the first to sixth embodiments.

As shown in FIG. 16 (B), the diameter of the outlet holes (H) of the shower nozzle (75) can be reduced gradually toward the direction of water spurting. In this case, the pressure of the shower water will become higher inversely with the size of the aperture provided by outlet holes (H).

Also, as shown in FIG. 16(C), the shower nozzle (76) can be supported between the plates with holes (77) and (78). Those plates should be made of hard plastic, metal or the like. The holes of the plates (77). and (78) can be connected with the outlet holes (H). The plates with holes (77) and (78) are fixed on the surface of the shower nozzle with the waterproofed adhesive agent. Supporting the shower nozzle (76) between the plates with holes (77) and (78) prevents the central area of the shower nozzle (76) from excessive expansion when it receives water at pressure so that the water can spurt straight from the shower nozzle. Also, even if the shower nozzle (76) receives water at excessive pressure, the plates with holes (77) and (78) prevent the elastic surface between each outlet hole (H), from breaking.

The shower nozzle (76) as shown in FIG. 16(C) incorporates tapered portions (T) toward the entrance of the outlet holes (H) such that the water inside the showerhead is introduced through the tapered surface and readily spouts from the outlet holes (H).

Figure 15:
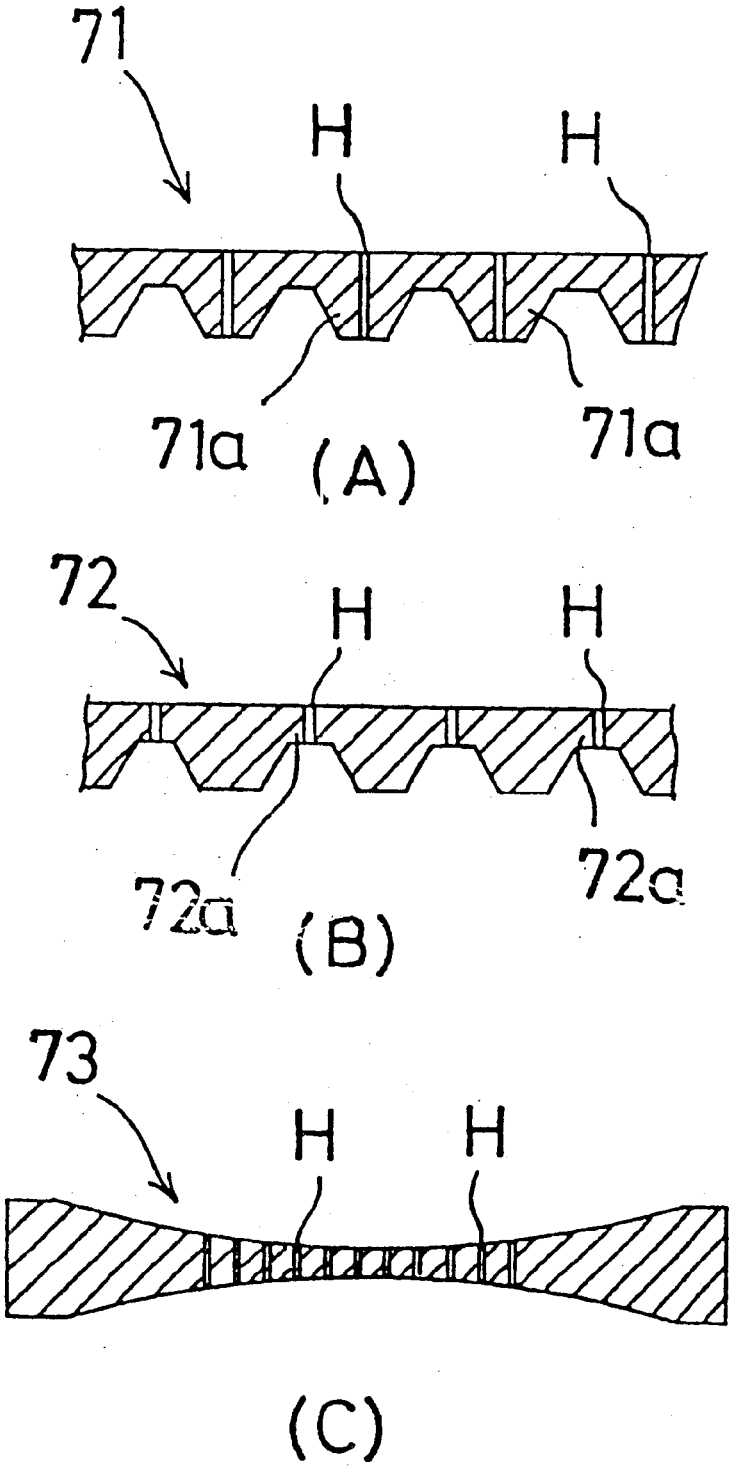
FIGS. 15(A)–15(C) are sectional views showing different types of shower nozzles as the first to sixth embodiments.

Different types of shower nozzles described in FIGS. 15 (A) to (C) and FIGS. 16 (A) to (C) can be used individually or in combination with other types of nozzles as required.

The showerheads proposed in the aforementioned first to sixth embodiment are designed for use with cold or hot water, however, this invention can be applied not only to the water but also to other liquids such as chemicals, fuels or the like.

As described in the above detailed description, the showerhead in this invention has features as follows.

(a) An appropriate and comfortable shower effect can be obtained regardless of changes in water pressure.

(b) Even if water pressure changes, it is not necessary to adjust water pressure at the faucet. Operation of the shower equipment thus becomes simpler.

(c) The shower nozzle comprises elastic materials such that the shower nozzle cannot easily be broken if it hits walls, floors or the like. Durability will thus be enhanced.

(d) Even if the volume of water is limited, effective shower water can be obtained. It is thus useful for saving water.

(e) The space inside the showerhead works as a chamber such that the water temperature and quality will be kept even and shower water continues to spurt from the shower nozzle.

What is claimed is:

1. A showerhead connected to a hose flowing water from a water source, comprising:

a shower nozzle having a flexible surface and is made of elastic and waterproof materials, the shower nozzle including outlet holes sizes of which can be enlarged and reduced in accordance with changes in water pressure in the showerhead;

a grip for holding the showerhead, where one end of the grip is connected to the hose and another end of the grip is structured to attach the shower nozzle thereto;

a ring stopper for firmly attaching the shower nozzle to said another end of the grip; and a protective plate provided in a waterway of the showerhead to support the flexible surface of the shower nozzle from inside the showerhead;

wherein an outer edge of the shower nozzle is enlarged in thickness and a channel is formed on said another end of the grip and/or the ring stopper to receive the outer edge of the shower nozzle therein, thereby securely attaching the shower nozzle to the grip.

2. A showerhead as defined in claim 1, wherein the shower nozzle is made of silicon rubber.

3. A showerhead as defined in claim 1, wherein a diameter (D) of the outlet holes is set between 0.1 mm and 0.9 mm when no water pressure is applied to the shower nozzle.

4. A showerhead as defined in claim 1, wherein said flexible surface of the shower nozzle is provided with convex and concave portions and wherein the outlet holes are optionally provided ether in the convex or concave portion.

5. A showerhead as defined in claim 1, wherein a diameter of the outlet holes decreases from inside to outside of the shower nozzle.

6. A showerhead as defined in claim 1, wherein each of said outlet holes is provided with a tapered edge at an inner surface of the shower nozzle.

7. A showerhead connected to a hose flowing water from a water source, comprising:

a shower nozzle having a flexible surface and is made of elastic and waterproof materials, the shower nozzle including outlet holes sizes of which can be enlarged and reduced in accordance with changes in water pressure in the showerhead;

a grip for holding the showerhead, where one end of the grip is connected to the hose and another end of the grip is structured to attach the shower nozzle thereto;

a water quality enhancer provided in a waterway of the showerhead;

a nozzle cap for firmly attaching the shower nozzle and the water quality enhancer to said another end of the grip; and a fixer provided between the shower nozzle and the water quality enhancer for fixing the shower nozzle on an inner edge of the nozzle cap, said fixer having a plurality of radial ribs extending from a center to an outer ring thereof;

wherein an outer edge of the shower nozzle is enlarged in thickness and a channel is formed on said another end of the grip and/or the nozzle cap to receive the outer edge of the shower nozzle therein, thereby securely attaching the shower nozzle to the grip.

8. A showerhead connected to a hose flowing water from a water source, comprising:

a shower nozzle having a flexible surface and is made of elastic and waterproof materials, the shower nozzle including outlet holes sizes of which can be enlarged and reduced in accordance with changes in water pressure in the showerhead;

a grip for holding the showerhead, where one end of the grip is connected to the hose and another end of the grip is structured to attach the shower nozzle thereto; and a ring stopper for firmly attaching the shower nozzle to said another end of the grip;

wherein an outer edge of the shower nozzle is enlarged in thickness and a channel is formed on said another end of the grip and/or the ring stopper to receive the outer edge of the shower nozzle therein, thereby securely attaching the shower nozzle to the grip; and wherein the shower nozzle is supported between plates with holes where each hole having a diameter larger than that of the outlet holes on the shower nozzle, and wherein the outlet holes are connected with the holes on the plates.

9. A showerhead connected to a pipe flowing water from a water source, comprising:

a showerhead bag which entirely covers a normal showerhead where an opening edge of the showerhead bag has a tightening structure to tightly mount the showerhead bag on the normal shower head in a manner to prevent water leakage; and a shower nozzle formed on a nozzle mat of the showerhead bag, the shower nozzle having a plurality of outlet holes for producing a spray of water;

wherein the shower nozzle is made of elastic and waterproof material thereby enabling to enlarge or reduce sizes of the outlet holes in accordance with changes in water pressure in the showerhead bag.

10. A showerhead as defined in claim 9, wherein the shower nozzle is made of silicon rubber.

11. A showerhead as defined in claim 9, wherein said nozzle mat on the showerhead bag has a higher elasticity than that of other part of the showerhead bag.

12. A showerhead as defined in claim 9, wherein a diameter (D) of the outlet holes is set between 0.1 mm and 0.9 mm when no water pressure is applied to the shower nozzle.

* * * * *